US008365780B2

(12) United States Patent
Meinzinger

(10) Patent No.: US 8,365,780 B2
(45) Date of Patent: Feb. 5, 2013

(54) METHOD FOR FILLING CONTAINERS

(75) Inventor: Rupert Meinzinger, Kirchroth (DE)

(73) Assignee: Krones AG, Neutraubling (DE)

( * ) Notice: Subject to any disclaimer, the term of this patent is extended or adjusted under 35 U.S.C. 154(b) by 742 days.

(21) Appl. No.: 12/276,730

(22) Filed: Nov. 24, 2008

(65) Prior Publication Data

US 2009/0133776 A1 May 28, 2009

(30) Foreign Application Priority Data

Nov. 28, 2007 (DE) ..... 10 2007 057 285

(51) Int. Cl.
*B65B 31/00* (2006.01)
*B65B 1/30* (2006.01)

(52) U.S. Cl. ..... 141/57; 141/83; 141/95

(58) Field of Classification Search ..... 141/1, 6, 141/52, 57, 89–92, 95, 96, 83
See application file for complete search history.

(56) References Cited

U.S. PATENT DOCUMENTS

| | | | | |
|---|---|---|---|---|
| 2,973,267 | A | 2/1961 | Keller et al. | |
| 3,993,111 | A * | 11/1976 | McLennand | 141/90 |
| 4,655,029 | A * | 4/1987 | Weiss | 53/432 |
| 4,976,295 | A * | 12/1990 | Clusserath | 141/39 |
| 5,313,990 | A * | 5/1994 | Clusserath | 141/6 |
| 5,634,500 | A * | 6/1997 | Clusserath et al. | 141/48 |
| 5,941,290 | A * | 8/1999 | Vaughn, Jr. | 141/90 |
| 6,213,169 | B1 * | 4/2001 | Clusserath | 141/49 |
| 7,143,793 | B2 * | 12/2006 | Vaughn, Jr. | 141/89 |
| 2006/0185755 | A1 | 8/2006 | Vaughn | |

FOREIGN PATENT DOCUMENTS

| | | |
|---|---|---|
| DE | 1114719 | 10/1961 |
| DE | 2739742 | 3/1979 |
| DE | 4343425 | 6/1995 |
| EP | 1544155 | 6/2005 |
| JP | 56106789 A | 8/1981 |
| JP | 2002096005 A | 4/2002 |
| JP | 2005178907 A | 7/2005 |

OTHER PUBLICATIONS

Zaitchik, Z.R., "Wine Industry Equipment", Publishing House "Food Industry", Moscow, 1968.
European Search Report for 08019762 mailed Mar. 4, 2009.
Japanese Office Action for P2008-304202 dated Jul. 5, 2011.

* cited by examiner

*Primary Examiner* — Jason J Boeckmann
*Assistant Examiner* — Steven M Cernoch

(57) ABSTRACT

A method for filling containers with liquid, where a gas displaced by the liquid out of the container escapes via a return gas path, and the return gas path is cleaned. To make such a method more economic and to save cleaning agents, the return gas path is only cleaned in case of need.

4 Claims, 1 Drawing Sheet

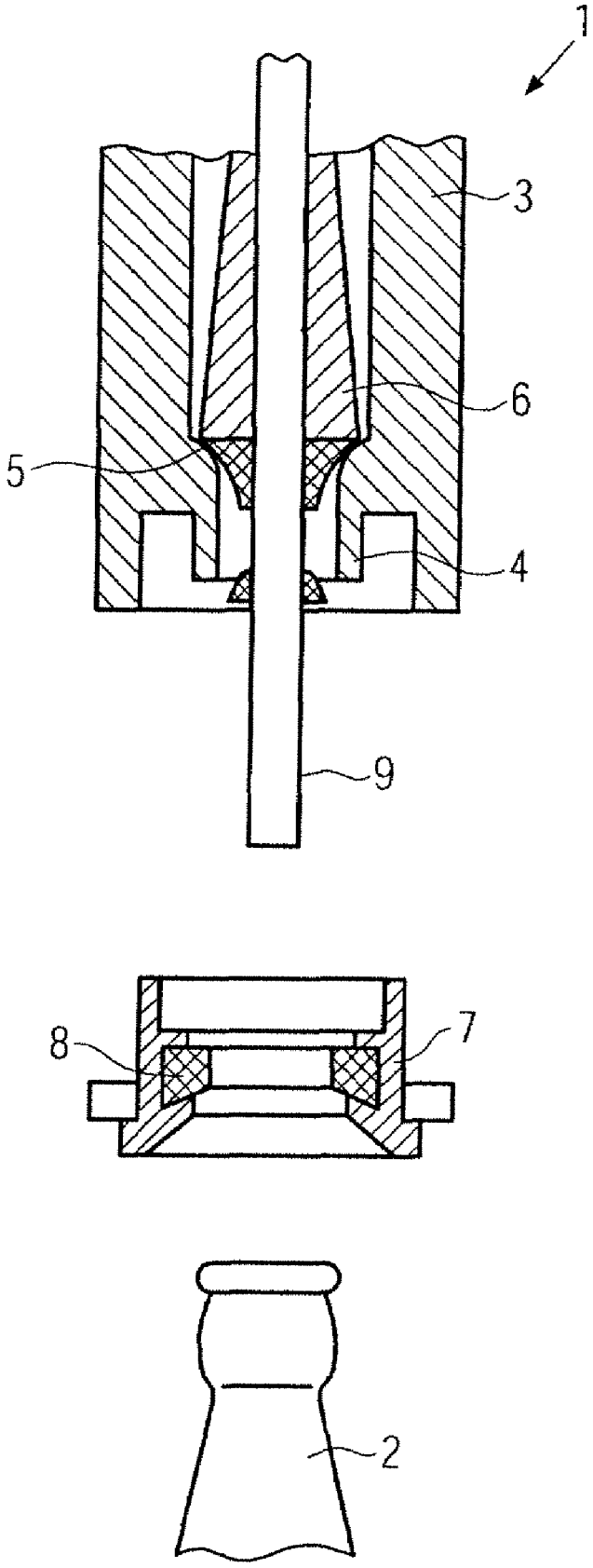
1
3
6
5
4
9
8
7
2

METHOD FOR FILLING CONTAINERS

CROSS-REFERENCE TO RELATED APPLICATION

The present application claims the benefit of priority of German Patent Application No. 102007057285.0, filed Nov. 28, 2007. The entire text of the priority application is incorporated herein by reference in its entirety.

FIELD OF THE DISCLOSURE

The present disclosure relates to a method for filling containers with such as in beverage bottling operations.

BACKGROUND

Such a method is known from DE-AS 1 114 719. This publication refers to a method for hot filling carbonated beverages, particularly beer. The beverage is here filled via a device comprising a valve-controlled filling element with an outlet opening through which the liquid passes into the container. There is also provided a return gas path in the form of a return gas tube that extends through the valve up into the container and through which the air displaced by the liquid can escape out of the container. Such return gas tubes also define the filling level in the container. Here liquid and possibly formed foam cannot be prevented from wetting the return gas tube on the outside and inside and from possibly getting stuck there. In a renewed filling process for a further container the foam stuck in the interior of the return gas tube and evolving from the preceding filling operation may for instance interfere with the new filling operation, i.e. for instance it may prolong the filling time, reduce the filling level or create an excessive amount of foam due to interference with the pressure relief in a clogged return gas tube. In the known method, the return gas tube is therefore spray-washed or blown out as a precautionary measure after each filling operation, so that liquid residues possibly contained in the return gas tube pass to the outside.

Blowing or spray-washing, however, constitutes an additional operation that needs time, whereby the filling operation is prolonged. Moreover, the cleaning agent is consumed. If water is used as the cleaning agent, it must be collected and discharged in addition. The return gas tube is blown out with inert gas, i.e. for instance $CO_2$, which passes into the atmosphere after blowing and is lost. Although the individual blow-off process requires a very small amount of gas, gas consumption will add up considerably due to the many blow-off processes.

SUMMARY OF THE DISCLOSURE

It is thus the object of the present disclosure to make the known method more economic.

Owing to the design according to the disclosure it is also possible to save a considerable amount of cleaning agent, i.e. particularly gas, because cleaning is only carried out in case of need.

Although the question whether a cleaning operation should be carried out can also be answered by directly determining the contamination in the return gas path, this is preferably determined indirectly.

The finding whether cleaning is needed can be made, for example, by determining process parameters and/or quality assurance criteria that must be determined at any rate in the course of the filling operation or thereafter and the deviation thereof from the set desired value could be ascribed to contamination of the return gas path.

Such criteria or parameters are e.g. the filling level reached in the container, the filling time by determining the filling end, excessive foaming, or the like.

Preferably cleaning is only carried out via a defined number of filling operations and is then terminated automatically until deviation from desired values is again determined.

Cleaning is preferably carried out by blowing off.

An embodiment of the method according to the disclosure shall now be explained in more detail with reference to the single FIGURE, which shows a filling head in a very schematized illustration.

BRIEF DESCRIPTION OF THE DRAWINGS

FIG. 1 is a schematic illustration showing a filling device of a filling machine for containers.

DETAILED DESCRIPTION OF THE PREFERRED EMBODIMENT

In the illustrated embodiment the filling device 1 is part of a rotation counter-pressure filling machine (not shown in more detail) for filling containers 2, such as bottles, with a $CO_2$-containing beverage. The filling device 1 includes a housing 3 on the lower end of which a filling pipe 4 is formed. This pipe is upwardly followed by a valve seat 5 which cooperates with a valve body 6 supported in a vertically movable way in housing 3. Due to the liquid valve formed in this way the outlet of the liquid into the container 2 is controlled. The control operation is here carried out via a control device (not shown) in such a way that the valve body 6 is lifted from the valve seat 5 for such a long time until the liquid in the container 2 has reached a predetermined filling level. This can be determined either via a desired value for a filling time that after a preceding test run should be adequate for filling the container 2 with the predetermined filling amount, with the valve being subsequently closed again, or the flow rate is measured, or the reached filling level is measured, or the like, while the parameters defining the filling level are monitored.

The filling device 1 further includes a centering bell 7 which is supported in a vertically movable way and is provided with a sealing ring 8. The centering bell 7 ensures an exact centering of the bottle mouth for the filling process. Furthermore, the sealing ring 8 effects a tight sealing between the bottle 2 pressed against the filling device 1 and the filling pipe 4.

The filling device 1 has further formed therein a return gas path which in the illustrated embodiment, as is in general use in filling machines, is configured as a return gas tube 9 that is arranged such that it extends into the container 2 when the container 2 is pressed against the centering bell 7 and the centering bell 7 is pressed against the housing 3 in the filling position. The return gas pipe 9 extends in the illustrated embodiment through an opening in the valve body 6.

For filling a container 2 the container is pressed against the centering bell 7 and the centering bell 7 against the housing 3. Depending on the type of liquid to be filled, pressure gas may e.g. be introduced via the return gas path into the container 2 before the liquid is filled in. This pressure gas or the air present in the container 2 is displaced during filling by the liquid and evacuated via the return gas path. After the predetermined filling level has been reached, at which the immersion depth of the return gas tube 9 into the container 2 can define the filling level, the filling operation is terminated and the container 2 is separated from the filling device 1. After the first container has been removed, the filling device 1 is prepared for filling a second container.

Before or after the closing operation the container 2 passes through various quality control stations in which it is e.g. determined whether the desired value of the filling level has been reached, whether excessive foam formation has taken place, or the like.

However, if deviations in the predetermined process sequence, e.g. variations in the filling processes or filling mistakes, are detected during the filling operation of the first container or during the quality control of the first container, for instance because any one of the operating parameters, such as the filling end (filling level), the filling duration (measure of the liquid throughput), or the like, and/or specific quality assurance criteria, such as the filling level detected in the container, the formation of foam, which hints at an uncontrolled relief, or the like, does not comply with the predetermined desired values (possibly within certain tolerance limits), one reason for this may be that the return gas path is soiled or clogged by liquid or foam. To eliminate the possible cause for failing to achieve the desired values, which cause is the easiest one to eliminate, i.e. contamination of the return gas path, a cleaning operation for the return gas path is started. In the illustrated embodiment the return gas path is cleaned by blowing off with the help of a gas jet, preferably an inert gas such as $CO_2$, or air, from the side oriented away from the container 2. Cleaning may be carried out by way of one or several air blasts through the same return gas path from the side oriented away from the container 2.

In case the contamination of the return gas path is not of an incidental nature, but is caused by the kind of liquid, or if it is detected that the contamination of the return gas path has accumulated due to a series of successive filling operations until an extent has been reached that brings the desired value of the parameters or quality criteria out of the range of tolerances, the cleaning operation can be carried out through a predetermined number of filling operations through the same filling device 1, or each time according to a predetermined number of filling operations. Adjacent filling devices can also be cleaned at the same time for a predetermined number of filling operations. The interposition of a cleaning step of the return gas path between two filling operations can also be limited in time. Furthermore, precautions can be taken where a cleaning process for the return gas path can be started by the operating personnel independently of the overall control during transition to a different product.

The invention claimed is:

1. A method for filling containers (2) with liquid comprising the following steps, wherein the container (2) is filled with the liquid and a gas displaced by the liquid out of the container (2) escapes via a return gas path (9); the container (2) is passed through a quality control station before or after a closing operation for determining deviations from predetermined quality assurance criteria; deviations from one of a predetermined process sequence or predetermined quality assurance criteria are detected during the filling operation or during the quality control of the container (2) according to at least one of the following criteria, wherein a filling end does not comply with a predetermined desired value; —a filling duration does not comply with a predetermined desired value; —a filling level does not comply with a predetermined desired value; —a measure of the liquid throughput does not comply with a predetermined desired value; and/or—a formation of foam does not comply with a predetermined value, and, if at least one of the criteria is fulfilled, the return gas path (9) is cleaned by blowing off with a gas jet or by way of one or several air blasts through the return gas path (9); and if none of the criteria is fulfilled, cleaning of the return gas path is not carried out.

2. The method according to claim 1, and carrying out cleaning at a predetermined number of filling operations.

3. The method according to claim 1 and carrying out cleaning for a predetermined filling period.

4. The method according to claim 2, and carrying out cleaning for a predetermined filling period.

* * * * *